United States Patent [19]

Tifre

[11] Patent Number: 4,691,453

[45] Date of Patent: Sep. 8, 1987

[54] SPACE SKATING SHOE

[76] Inventor: Salustiano Tifre, 496 New Jersey Ave., Brooklyn, N.Y. 11207

[21] Appl. No.: 906,262

[22] Filed: Sep. 8, 1986

[51] Int. Cl.[4] ..... A43B 5/12; A43B 5/16

[52] U.S. Cl. ..... 36/8.3; 36/113; 36/115; 280/11.1 BR

[58] Field of Search ..... 36/8.3, 113, 114, 115, 36/1, 129, 15, 130; 280/11.1 BR

[56] References Cited

U.S. PATENT DOCUMENTS

| | | | |
|---|---|---|---|
| 862,431 | 8/1907 | Armband | 280/11.1 BR |
| 1,184,702 | 5/1916 | Staubach et al. | 36/15 |
| 1,271,891 | 7/1918 | Gustin | 280/11.1 BR |
| 1,723,375 | 8/1929 | Rubin | 36/8.3 |
| 3,552,040 | 1/1971 | Welco et al. | 36/130 X |
| 4,262,434 | 4/1981 | Michelotti | 36/129 X |

FOREIGN PATENT DOCUMENTS

| | | | |
|---|---|---|---|
| 2821644 | 11/1979 | Fed. Rep. of Germany | 36/114 |
| 330508 | 6/1903 | France | 280/11.1 BR |
| 634378 | 11/1927 | France | 36/130 |
| 455396 | 2/1950 | Italy | 36/130 |
| 533957 | 2/1941 | United Kingdom | 280/11.1 BR |

*Primary Examiner*—James Kee Chi

*Attorney, Agent, or Firm*—Richard L. Miller

[57] ABSTRACT

A shoe is provided in which spherical steel balls are rotatively mounted in the sole so as to allow the wearer to roll in any desired direction. A tool is also provided for removing the spheres as required.

5 Claims, 5 Drawing Figures

SPACE SKATING SHOE

BACKGROUND OF THE INVENTION

This invention relates to footwear for sports and the like, and more specifically to footwear for rolling about.

While there are many conventional fun-wear shoes such as those described in U.S. Pat. Nos. 2,124,458; 3,091,043 and 3,204,348 none of these conventional shoes have a mechanism as suitable for rolling about as the instant invention herein disclosed.

SUMMARY OF THE INVENTION

It is therefore the primary object of the present invention to provide footwear with the unique property of having spherical steel balls which are located in the soles and are capable of rolling in such a way as to allow the wearer to propel himself/herself about in all directions.

Another object is to provide a fun recreation shoe which permits the wearers to dance, skip, slide and amuse themselves in other various way.

Still another object is to provide a shoe in which the spherical balls can be easily removed from the footwear so as to be cleaned.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
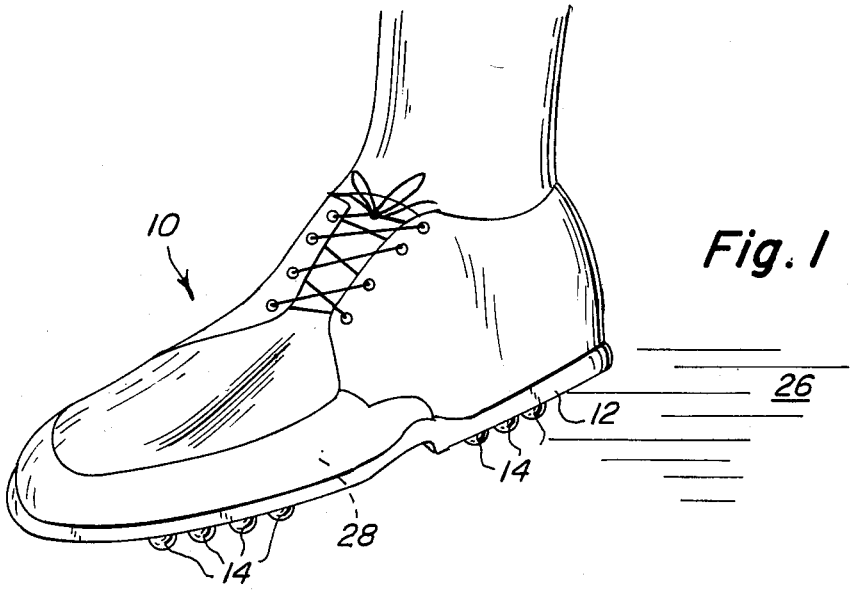
FIG. 1 is a perspective view of the invention on a wearer's foot.

Turning now descriptively to the drawings, in which similar reference characters denote similar elements throughout the several views, FIGS. 1 through 5 illustrate a sport shoe for use upon the foot 28 of a wearer for the purpose of rolling about. The shoe generally illustrated by reference numeral 10 has a polytetrafluoroethylen (generally known by the TEFLON®) sole 12. Each TEFLON® sole 12 has spherical steel balls 14 mounted therein as seen in FIG. 1.

Figure 2:
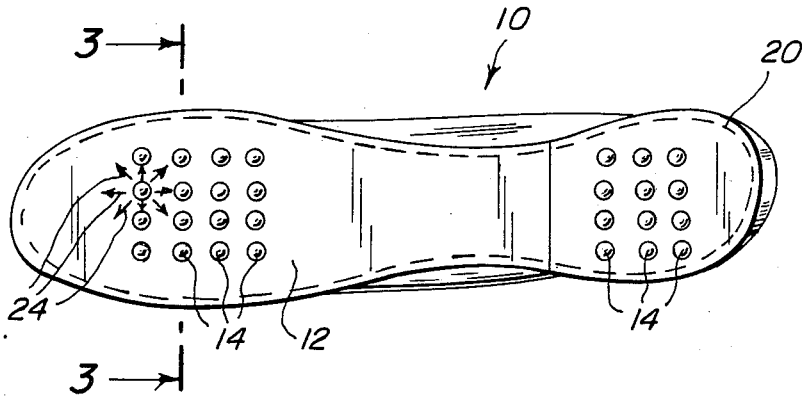
FIG. 2 is a bottom view showing the TEFLON® sole with spherical balls therein.

FIG. 2 is a bottom view showing the TEFLON® sole 12 with spherical steel balls therein in identical rows at the front and heel of each shoe.

When the person wears the shoe and pushes in a particular direction the spherical steel balls will rotate allowing the wearer to roll or slide in an opposite direction from which he/she is pushing.

Figure 3:
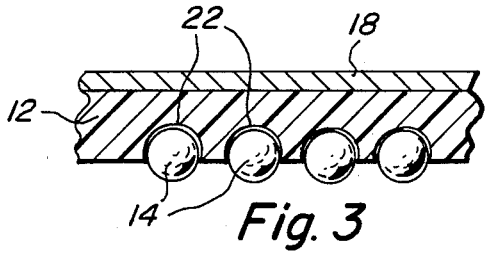
FIG. 3 is an enlarged cross sectional view taken along line 3—3 in FIG. 2 showing the spherical balls in greater detail.

FIG. 3 illustrates the spherical steel balls 14 in greater detail. At the top of the figure is seen the inner sole 18 which is conventional and to which TEFLON® sole may be sewn with stitching 20 or attached in any other state of the art manner.

It is to be observed that the spherical steel balls 14 are trapped in hemispherical cavities 22 within the TEFLON® sole 12. The cavities are a loose fit but engulf more than 180° of the circumference of the spheres so that they are retained by the sole.

The choice of the material TEFLON® for the sole is not an accident, it serves the purpose of together with the loose fit of permitting the spheres 14 to rotate freely in any direction inside the cavity, in response to external forces 24 that may be applied to them by the surface 26 upon which the wearer is skating.

Figure 4:
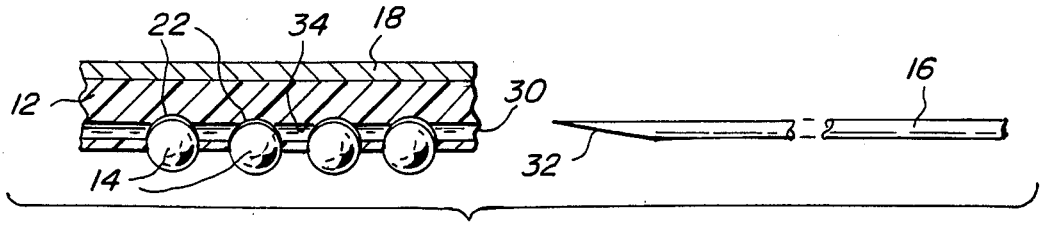
FIG. 4 is a view similar to FIG. 3 showing how the spherical steel ball can be removed for cleaning and a tool for the accomplishment of such.

FIG. 4 shows a modification in which the spherical steel balls 14 can be easily removed for cleaning and a tool 16 for the accomplishment of such.

Figure 5:
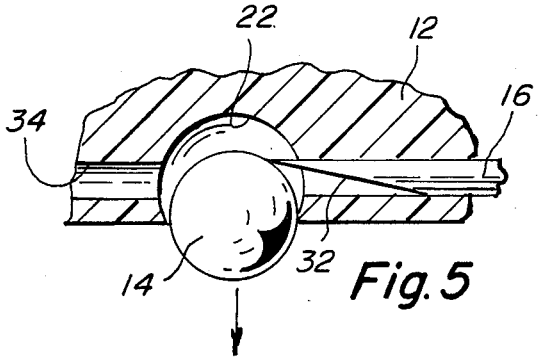
FIG. 5 is an enlarged cross sectional view showing in greater detail how a sphere may be removed.

When it is desired to remove the spheres 14 for cleaning, replacement, etc., a specifically designed tool 16 is inserted in an opening 30 through passageway 34 located in the sole 12 as better seen in FIG. 5.

The tool 16 has a pointed wedge shaped end 32 which can slide into passageway 34 in between a typical cavity 22 and sphere 14 forcing the sphere out of the cavity in the bottom of the TEFLON® sole 12. Because typically four spheres are in a line in each row all four spheres can be removed with a single insertion of the tool.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A space skating shoe for recreation activities which comprises:

(a) a shoe portion for wearing upon the user's foot;

(b) a sole having a plurality of cavities recessed into the sole;

(c) means for attaching said sole to the bottom of said shoe portion; and (d) a plurality of spherical balls rotatively mounted in said cavities with said cavities engulfing more than 180 degrees of said spherical balls thereby permitting said spherical balls to rotate freely in any direction, said spherical balls fitting loosely in said cavities but being prevented from being freely separated from said sole by the engulfing of said cavities, said spherical balls spacing said sole from a skating surface and permitting the user to propel himself in any desired direction, and wherein said sole is fabricated out of polytetrafluoroethylene material for permitting smooth rotation of the balls within the cavities and permitting forced removability of the spherical balls from the cavities for replacement of the spherical balls.

2. A space skating shoe as recited in claim 1, wherein means for attaching said sole to the bottom portion of said shoe is stitching.

3. A space skating shoe as recited in claim 1, wherein means are provided for removing said spherical balls from said sole as desired by the user.

4. A space skating shoe as recited in claim 3, where means for removing said spherical balls from said sole are:

(a) a passage way in the sole of said shoe in axial alignment with said cavities; and (b) a pointed wedge shaped tool which fits within said passage way whereby when said tool is force through said passage way said spherical balls are extricated from said cavities.

5. A space skating shoe as recited in claim 4, wherein said spherical balls are arranged in aligned rows and columns, said passageways being correspondingly aligned behind said rows and columns, whereby an entire row or column of spherical balls can be removed with a single insertion of the tool.

* * * * *